United States Patent [19]

Gleichner

[11] 4,168,585

[45] Sep. 25, 1979

[54] HEEL CUSHION

[76] Inventor: Eleanor R. Gleichner, 5603 Halifax Rd., Arcadia, Calif. 91006

[21] Appl. No.: 895,241

[22] Filed: Apr. 10, 1978

[51] Int. Cl.[2] ..... A43B 7/16; A43B 21/32; A43B 23/08

[52] U.S. Cl. ..... 36/95; 36/37; 36/69; 36/71; 128/614

[58] Field of Search ..... 36/95, 37, 71, 69, 81, 36/32 R; 128/581, 596, 614

[56] References Cited

U.S. PATENT DOCUMENTS

| | | | |
|---|---|---|---|
| 1,721,714 | 7/1929 | Ross | 36/37 |
| 2,826,834 | 3/1958 | Ratcliff | 128/614 |
| 3,244,176 | 4/1966 | Neu | 128/581 |
| 3,821,135 | 6/1974 | King | 36/37 X |
| 3,984,926 | 10/1976 | Calderon | 36/37 |

FOREIGN PATENT DOCUMENTS

| | | | |
|---|---|---|---|
| 2731533 | 1/1978 | Fed. Rep. of Germany | 36/32 R |
| 21103 | of 1905 | United Kingdom | 36/37 |

*Primary Examiner*—James Kee Chi

*Attorney, Agent, or Firm*—Fred N. Schwend

[57] ABSTRACT

A one-piece heel cushion formed of homogeneous elastomeric material adapted to conform to the insole of a wearer's shoe to relieve the pain of a heel spur. The cushion tapers toward its forward end and has an elongate cavity in the lower surface thereof extending directly under the heel bone, and a slight concavity in the upper surface located over the cavity. The cavity is approximately one-third the height of the cushion at it's rear end resulting in a bridging section over the cavity which flexes under the weight of a person's heel while the portions of the cushion surrounding the cavity bear the major portion of the wearer's weight.

1 Claim, 4 Drawing Figures

HEEL CUSHION

BACKGROUND OF THE INVENTION

1. Field of the Invention

This invention relates to foot appliances and has particular reference to a cushion for supporting the heel of the wearer against shock and jarring action.

2. Description of the Prior Art

Many people, such as athletes, who do considerable walking, jumping or the like often develop "spurs" on the underside of their heel bone. Such spurs cause considerable pain due to the pressure of the spur against the flesh of the heel when the person stands or otherwise applies the weight of his body against the heels of his feet.

Various heel cushions have been proposed heretofore to resiliently cushion a person's heel to either prevent the development of spurs or to reduce the pain caused by already developed spurs when walking, standing or otherwise moving about on one's feet. These, however, have not proved satisfactory and foot sufferers, particularly those with spurs on their heel bones, are still searching for a completely satisfactory heel cushion which would enable them to stand or move about without pain.

For example, the U.S. Pat. No. 1,945,780 to Johnson discloses a heel cushion made of leather or the like with a cavity therein over which a thin cover sheet, also of leather, is secured. In use, the wearer's heel rests on the cushion with the heel bone supported by the cover sheet in a position located over the cavity. Although such construction may appear theoretically satisfactory, a relatively sharp line of pressure exists around the edge of the cavity which could cause additional discomfort. Additionally, when the person comes down hard on his heel, the thin cover sheet can yield sufficiently to permit the overlying heel portion to bottom out on the underlying sole portion of the shoe, causing excruciating pain. To obviate this possibility, the cushion would have to be made excessively thick. Further, such construction is formed of two parts which must be suitably secured together and to the insole of the wearer's shoe.

More recently, heel cushions which have been developed to reduce the pain caused by heel spurs, have generally been more sophisticated and costly. For example, the U.S. Pat. No. 3,777,419 to Analick discloses a multi-piece cushion construction in which parts must be adjusted to locate a relatively small cavity directly under the wearer's spur. This construction requires a trial-and-error adjustment of the parts until the cavity is properly located under the spur. Also, the edge of the cavity, since it is directly in engagement with the wearer's heel, may cause a sharp line of pressure to cause discomfort. Further, the remaining portions of the cushion surrounding the cavity present a solid under-structure which may not adequately cushion against shocks incurred during walking or the like since the cushion must be made of relatively stiff material.

SUMMARY OF THE INVENTION

It therefore becomes a principal object of the present invention to provide a heel cushion which forms a central yielding resilient support for a person's heel in that area in which spurs may occur while providing an outer resilient support section for the remainder of the person's heel, wherein the degree of resiliency changes gradually from the center to the outer section.

Another object is to provide a heel cushion of the above type which requires no modification of the person's shoes.

Another object is to provide a one-piece heel cushion of the above type which is lightweight, easy to clean and inexpensive to manufacture.

A further object is to provide a one-piece heel cushion of the above type which is impervious to moisture, perspiration and odors and which may be easily cleaned.

According to my invention, a heel cushion is formed of a one-piece pad of homogeneous elastomeric material, such as solid rubber, having a Shore hardness in the neighborhood of 65 as measured on the A-scale of a Shore durometer. Such cushion has an elongate cavity on its underside which has a width approximately one-third the width of the wearer's heel and a depth approximately one-third the thickness of the cushion. A slight concavity is formed in the upper surface of the cushion directly over the cavity. When the wearer rests his weight on the cushion, the portion of the cushion directly over the cavity forms a cradle which, due to the elastic nature of the material, tends to readily yield and thus provide a soft cushioning effect to the portion of the heel where a spur may occur while the main support is given by a portion of the cushion surrounding the cavity. However, no sharp line of pressure exists in the area directly above the edge of the cavity. That is, due to the thickness of that portion of the pad directly over the cavity, a gradual change in resiliency exists from the central portion of the cushion to the outer portion thereof surrounding the cavity. This prevents bottoming-out of the wearer's heel if he should come down hard while still enabling the center section to yield sufficiently to prevent or reduce the possibility of pain due to spurs. The elongate cavity and bridging section directly above it improves the yielding characteristic of the center section and enables the cushion to be made relatively thin while retaining the foregoing advantageous feature. Since the pad is constructed of a one-piece homogeneous elastomeric material, it will not absorb moisture, perspiration or odors and may be readily cleaned. Further, because of the frictional quality of the rubbery material and because of the resulting conformity of the central portion of the cushion to the contour of the wearer's heel portion causing it to hug the wearer's foot, it will not tend to slide or shift relative to either the wearer's foot or shoe and therefore need not be attached to the inner shoe sole.

BRIEF DESCRIPTION OF THE DRAWINGS

The manner in which the above and other objects of the invention are accomplished will be readily understood on reference to the following specification when read in conjunction with the accompanying drawing; wherein.

DESCRIPTION OF THE PREFERRED EMBODIMENT

Figure 1:
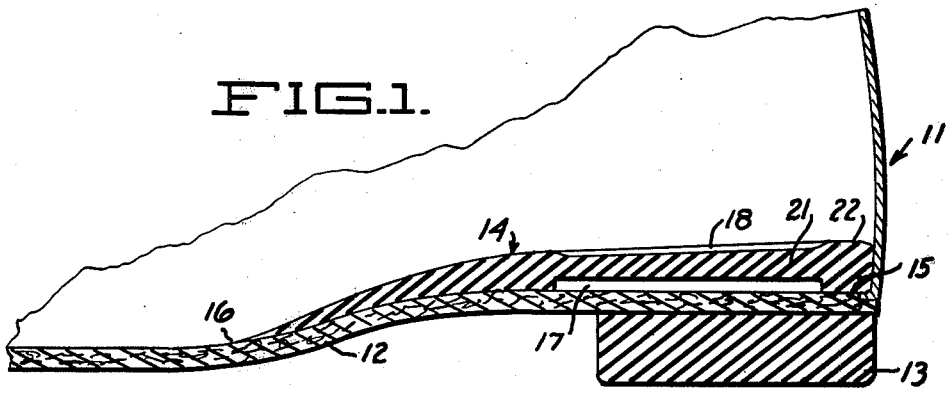
FIG. 1 is a sectional side view of a portion of a shoe, illustrating a heel cushion inserted therein which is constructed in accordance with my invention.
Figure 2:
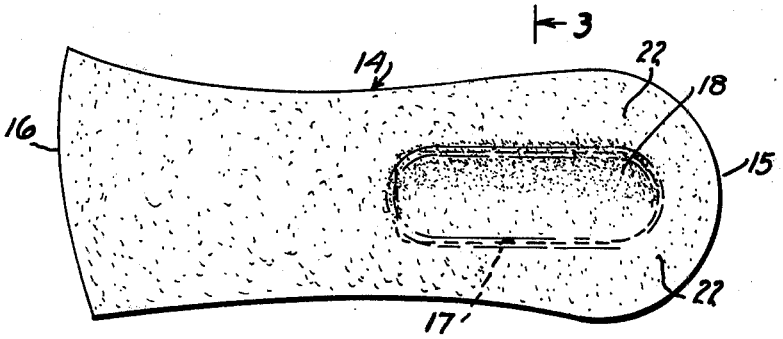
FIG. 2 is a top plan view of the heel cushion.

While my invention is susceptible of embodiment in many different forms, there is shown in the drawings and will be described in detail one specific embodiment, with the understanding that the particular disclosure is to be considered as an exemplification of the principles of the invention and is not intended to limit the invention to the embodiment illustrated.

Referring to the drawings, a conventional man's shoe, generally indicated at 11, is depicted having an instep sole 12 and a heel 13 suitably secured to the under surface of the sole 12.

According to my invention, a heel cushion or pad, generally indicated at 14, is provided which gradually tapers forwardly from its rear end portion 15 to a forward edge 16. The cushion 14 is substantially the same shape, when viewed in plan, as the interior of the shoe 11 and is formed of a homogeneous elastomeric material, preferably runner, having a Shore hardness of 64 on the A-scale of a Shore durometer. Such material enables the cushion to readily conform to the curvature of the insole 12 as seen in FIG. 1. I have found that a rubber material commercially available under the trade name "21 Oil Resist Iron (Crepe)" is admirably suited for this purpose.

Figure 3:
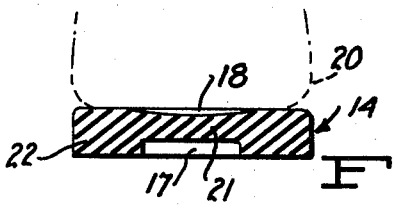
FIG. 3 is a transverse sectional view of the heel cushion and is taken along the line 3—3 of FIG. 2.
Figure 4:
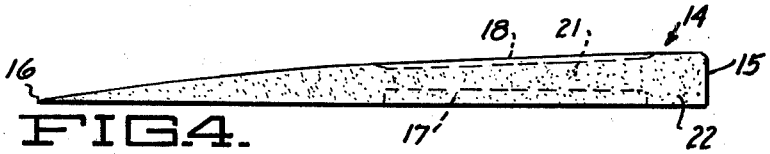
FIG. 4 is a side view of the heel cushion.

An elongate cavity 17 is formed in the under surface of the cushion adjacent the rear end thereon in a location spanning the area of the heel bone in which spurs normally occur. Such cavity 17 is approximately one-third the width of the cushion 14 and is approximately three times as long as its width. The height of the cavity 17 is approximately one-third the height of the cushion at its rearmost end and a slight concave depression 18 is formed in the upper surface of the cushion directly over the cavity 17 to receive the wearer's heel as depicted by the dotted lines 20 in FIG. 3. The concavity 18 has a width and length substantially the same as that of cavity 17.

Accordingly, when the wearer places his weight on the cushion 14, the bridging section 21 intermediate the cavity 17 and the concavity 18, forms a soft resilient support underlying the heel bone and any spur that may be formed thereon. That is, the central portion of the section 21, where most spurs occur, will yield the most. However, the main support for the heel is derived from the solid portion, i.e. 22, surrounding the cavity 17. The transition of yielding characteristic from the bridging portion 21 to the solid portion 22 will be gradual due to the thickness of such bridging portion 21 so that no sharp line of resistance exists between the two. Accordingly, when the wearer places his weight on the cushion 14, the bridging portion 21 will yield to a greater extent due to tensional stresses set up therein while the outer portion 22 will be compressed to absorb the major portion of the wearer's weight. Thus, there will be no tendency for a spur to create discomfort during normal use and, due to the aforementioned shape of the cushion, there will be no tendency for the central bridging portion of the cushion to bottom out against the upper surface of the sole 12 due to any abnormal downward pressure of the wearer's heel against the cushion.

Due to the elongate shape of the cavity 17, the bridging portion 21 will tend to bend transversely only along the length of the cavity, thereby increasing the resiliency of the bridging portion and tending to cradle the wearer's heel.

Obviously, the cushion 14 may be equally well applied to shoes for both men and women.

I claim:

1. A heel cushion for relieving pain caused by pressure of a person's heel spur, said cushion being adapted to be fitted in the heel section of a shoe, which comprises a pad of homogeneous elastomeric material having a Shore hardness of approximately 65 degrees on the A-scale, said pad tapering from its rear end to a thin forward edge, said pad having a cavity in the under surface thereof adjacent the rear of said pad, said cavity having a height approximately one-third the height of said rear end of said pad, and said pad having a concavity in the upper surface thereof substantially directly over said cavity to receive the heel portion of the person, said cavity being elongated in the direction of the length of said pad and being substantially three times longer than the width thereof and being substantially one-third the width of said pad.

* * * * *